United States Patent [19]

Roosa

[11] 4,100,903

[45] Jul. 18, 1978

[54] ROTARY DISTRIBUTOR FUEL INJECTION PUMP

[75] Inventor: Vernon D. Roosa, West Hartford, Conn.

[73] Assignee: Stanadyne, Inc., Windsor, Conn.

[21] Appl. No.: 750,276

[22] Filed: Dec. 13, 1976

[51] Int. Cl.[2] ..... F02M 39/00

[52] U.S. Cl. ..... 123/139 AQ; 123/139 AS; 417/214; 417/273

[58] Field of Search ..... 123/139 AB, 139 AD, 123/139 AL, 139 AP, 139 AQ, 140 FG, 139 AS; 417/251, 252, 494, 499, 206, 273, 214

[56] References Cited

U.S. PATENT DOCUMENTS

| | | | |
|---|---|---|---|
| 2,263,786 | 11/1941 | Rumpp, Jr. | 417/273 |
| 2,650,543 | 9/1953 | Pauget | 417/214 |
| 2,660,992 | 12/1953 | Roosa | 123/139 AQ |
| 3,486,492 | 12/1969 | Lehnerer | 123/139 AQ |
| 3,494,288 | 2/1970 | Watson | 123/139 AQ |
| 3,699,939 | 10/1972 | Eckert et al. | 123/139 AS |
| 4,037,573 | 7/1977 | Swift | 123/139 AQ |
| 4,037,574 | 7/1977 | Swift | 123/139 AQ |

*Primary Examiner*—Charles J. Myhre
*Assistant Examiner*—R. A. Nelli
*Attorney, Agent, or Firm*—Prutzman, Hayes, Kalb & Chilton

[57] ABSTRACT

The disclosed liquid fuel injection pump is suited for the delivery of measured charges of liquid fuel under high pressure sequentially to the cylinders of an associated engine and includes a free piston type plunger reciprocably mounted in a pump chamber, wherein the charges are pressurized to high pressure, a stop for the pump plunger to limit the maximum volume of the chamber, a hub mounting a plurality of rollers to engage the camming surface of a tappet interposed between the plungers and the rollers to drive the pump plungers in a direction to reduce the volume of the pump chamber, and hydraulic means to power said pump plunger in the opposite direction. The hydraulic means includes a passage containing fuel under pressure in continuous communication with the pump chamber with a one-way valve in the passage unseated by the pressure therein after the release of the pump plunger by the rollers to hydraulically power the plunger against said stop and fully charge said pump chamber prior to each pumping stroke of the pump plunger, the tappet being mounted by a timing piston to shift the timing of the pumping strokes according to engine operating parameters. A spill metering system is disclosed with the spilled fuel being stored in an accumulator to supply the fuel for the succeeding pumping stroke. The hub is hollow and mounts Z-shaped flyweights so that they are insensitive to shock forces and have a rate of increase in their rotating moment substantially less than a square function of speed to provide, in cooperation with a unique pressure regulator, a control pressure for the governor and timing functions of the fuel injection.

37 Claims, 5 Drawing Figures

ROTARY DISTRIBUTOR FUEL INJECTION PUMP

The present invention relates to fuel injection pumps for supplying precisely measured charges of liquid fuel under high pressure to an internal combustion engine and more particularly to such a pump having a single pumping chamber and a rotary distributor suited for delivering the measured charges of fuel sequentially to a plurality of cylinders of a compression-ignition engine.

It is the principal object of this invention to provide a new and improved fuel injection pump which is capable of delivering precisely measured charges of fuel of widely varying quantities to the engine over a wide speed range.

A still further object of this invention is to provide a fuel injection pump having a new and improved arrangement for generating the hydraulic pressure used for providing a control signal correlated with speed.

Another object of this invention is to provide a fuel injection pump of the type described incorporating an improved arrangement for hydraulically charging the pump chamber.

Another object of this invention is to provide a new and improved fuel injection pump of the type described which is compact and economical in construction and efficient in operation.

A still further object of this invention is to provide a new and improved fuel injection pump wherein the fuel distributing rotor is independent of the pumping member to avoid the imposition of axial or side loading on the fuel distributing rotor due to the functioning of the pumping member.

A further object of this invention is to provide a relatively simple arrangement for automatically controlling the timing of injection in accordance with engine requirements. Included in this object is the provision for a new and improved control arrangement for the timing of injection.

Another object of this invention is to provide a new and improved fuel injection pump including an improved hydraulic control for regulating the timing of injection, scheduling the maximum quantity of fuel delivered by the pump per pumping stroke according to engine speed, and for positively shutting down the pump and the engine under selected conditions.

Another object of this invention is to provide an improved fuel injection pump having a single pumping element coupled with speed governing, variable timing of injection, scheduled torque control, and adapted to provide excess fuel at cranking, all under the automatic control of a hydraulic pressure signal generated by the pump.

A still further object of this invention is to provide a new and improved fuel injection pump readily adapted for use with engines having an odd number of cylinders and for use with some V-type engines requiring pumping strokes at uneven intervals.

Other objects will be in part obvious and in part pointed out more in detail hereinafter.

A better understanding of the invention will be obtained from the following detailed description and the accompanying drawings of an illustrative application of the invention.

Figures 1, 2:
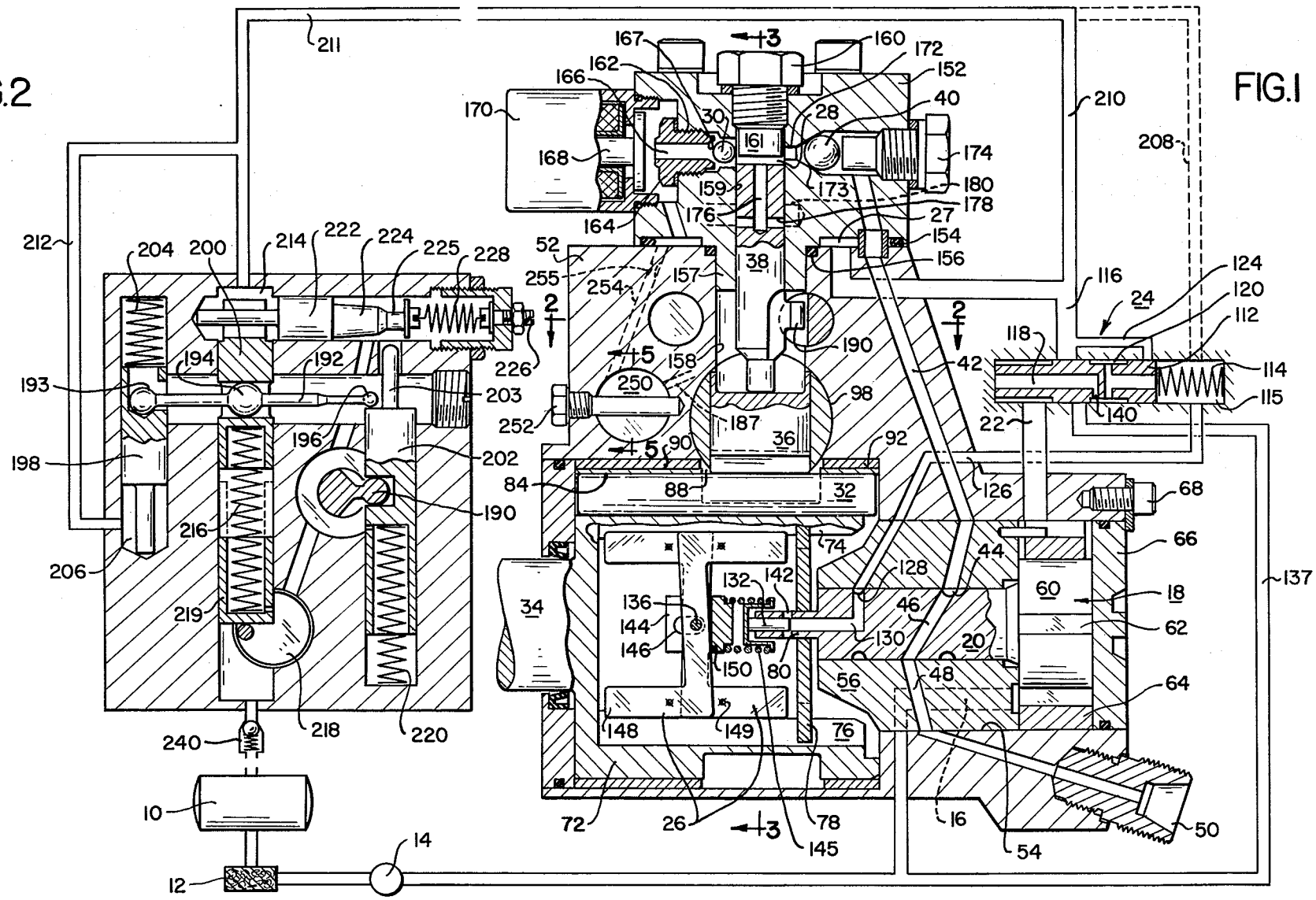
FIG. 1 is an illustrative embodiment of the new and improved fuel injection pump of the present invention, partly in longitudinal cross-section and partly schematic.
FIG. 2 is a cross-sectional view along line 2–2 of FIG. 1.

Referring now to the drawings, and particularly to FIG. 1, fuel from a fuel tank 10 is shown as being delivered through a fuel filter 12 and a low pressure boost pump 14 to the inlet 16 of a positive displacement vane type transfer pump 18 drivingly connected to the distributor rotor 20 to rotate therewith. The output of the transfer pump 18 is delivered by a passage 22 to a pressure regulator 24 which cooperates with flyweights 26, as hereinafter more fully described, to provide a hydraulic pressure correlated with engine operating speed.

Fuel from the transfer pump and having a speed related pressure is delivered to an annulus 27 from which it is delivered to the high pressure pump chamber 28 past an inlet ball check valve 30. When the pumping chamber 28 is filled, as hereinafter more fully described, a roller 32 mounted by the drive shaft 34 engages a tappet 36 to transmit an upward stroke to the high pressure free-piston type pump plunger 38 to pressurize the fuel in pump chamber 28 and deliver the pressurized fuel to the distributor rotor 20 past one way delivery value 40, through passage 42 which continuously communicates with annulus 44 of the distributor rotor 20. The fuel flows through cross passage 46 in the distributor rotor to a delivery passage 48 when cross passage 46 and delivery passage 48 are in registry to deliver the charge of fuel to nipple 50 for delivery to an associated fuel injection nozzle of the engine.

Further rotation of the rotor 20 produces sequential pumping strokes of pump plunger 38 to pressurize and deliver subsequent charges of fuel to the other nipples (not shown) corresponding to nipple 50 which are disposed around the periphery of the pump and have delivery passages which sequentially register with the single cross passage 46 during each pumping stroke of pump plunger 38 during each rotation of rotor 20.

To discuss the foregoing in greater detail, the illustrative pump includes a housing 52 provided with a stepped bore 54 in which an annular sleeve 56 is permanently fixed and sealed. The annular sleeve 56 is in turn provided with a bore in which the rotor 20 is precision journaled for rotation therein. The right end of the sleeve 56 (FIG. 1) is spaced from the end of the housing to receive an enlarged hub 60 on the end of the rotor 20. The hub 60 is provided with a pair of intersecting radial slots in which pumping vanes 62 are mounted for reciprocation as a result of their engagement with the inner surface of eccentric ring 64. An end plate 66 is sealingly received within the end of the bore 54 and is secured therein by any suitable means such as a plurality of retaining screws 68 (only one of which is shown).

The drive shaft 34 is adapted to be driven by the associated engine and is provided with an enlarged hollow cylindrical bearing hub 72 which is sized so as to be journaled by a bushing within a larger portion of the stepped bore 54 of the housing which serves as a backing surface therefor.

The interior of the hollow hub 72 is provided with a pair of longitudinally extending grooves 74, 76 which receive the ears of a rotor drive plate 78. The rotor 20 is provided with an axially projecting noncircular hollow drive tang 80 which is received within a mating centrally disposed aperture of the drive plate 78 for drivingly connecting the rotor 20 to the drive shaft 34 without imparting axial or radial forces therebetween.

The enlarged bearing hub 72 of the drive shaft 34 is provided with a plurality of longitudinally extending spaced bores 84 in which rollers 32 are journaled. As shown in FIG. 1, the longitudinal midsection of the hub 72 is turned to a reduced diameter as indicated at 88 to intersect the bores 84 and expose the rollers 32. As shown, less than half the diameters of the bores is cut away to provide a large reaction surface during pumping strokes and to confine the rollers against centrifugal force. Uninterrupted cylindrical bearing surfaces 90 and 92 are provided at the sides of hub 72. A plurality of radially extending passages 94 (FIG. 3) are provided through the hub 72 so as to provide free communication between the interior and the exterior of the midsection of the hub.

Figure 3:
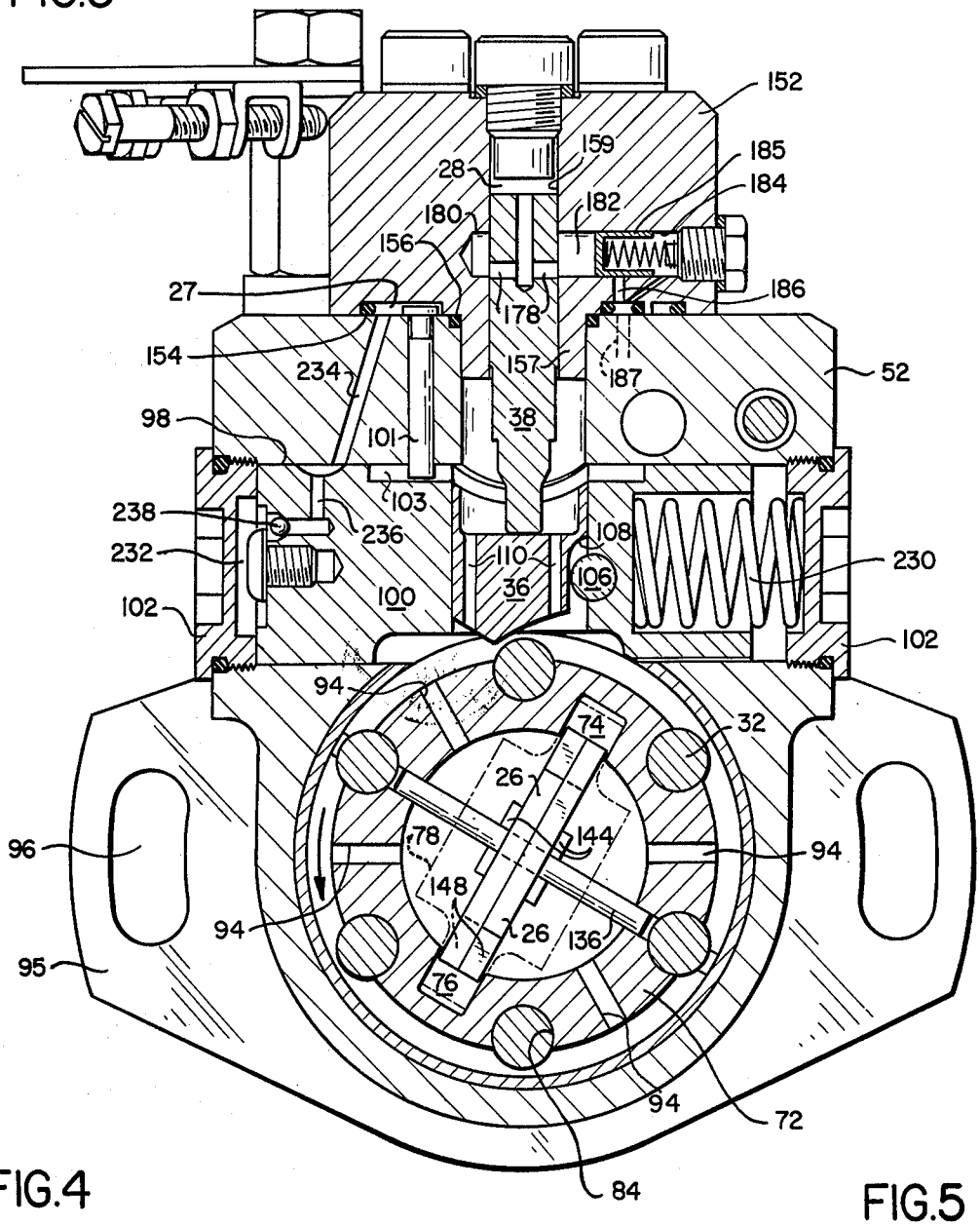
FIG. 3 is an enlarged transverse cross-sectional view taken along the line 3–3 of FIG. 1.

As shown in FIG. 3, the housing 52 is provided with a mounting flange 95 having elongated apertures 96 for receiving mounting bolts to secure the pump to a mouting pad of the associated engine.

The housing 52 is also provided with a through bore 98 (FIG. 3) for slidably receiving an advance piston 100. End caps 102 seal the ends of the bore 98, and a pin 101 received in a longitudinal groove 103 of the advance piston secures the advance piston againt rotation relative to the housing 52.

The advance piston 100 includes a cross bore for slidably mounting the tappet 36 and a cross pin 106, secured in a cross bore of the advance piston, is engageable with a shoulder 108 of the tappet 36 to rotationally orient and limit the downward movement of the tappet. Tappet 36 is provided with a plurality of openings 110 which serve to limit the mass of the tappet and also to provide open communication between its upper and lower surfaces for the free passage of fuel therebetween.

The tappet 36 is provided with an upper flat surface to engage the end of the pump plunger 38 to transmit the pumping force from the rollers 32 to provide the pumping stroke of the plunger upon the rotation of the drive shaft 34.

Referring to FIG. 1, the pressure regulator 24 is provided with a regulator piston 112 and includes a spring 114 which biases the regulator piston 112 to the left so that, in a static condition, the regulator piston 112 shuts off outlet passage 116 and prevents fuel from the transfer pump 18 to flow to the high pressure pump chamber 28.

As cranking beings, and the rotor 20 and the transfer pump 18 begin to rotate, the output of transfer pump 18 moves the regulator piston to the right against the bias of spring 114 to uncover the inlet port of passage 116 to provide fuel to the high pressure pump chamber 28. At the same time, fuel flows through the axial passage 118 in the regulator piston 112 and into the annulus 120 thereof to deliver fuel to spring chamber 115 which is in continuous communication with passage 130 of the rotor 20 through passage 126 and annulus 128. Spill from passage 130 through ports 142 is regulated by a pin 132 which in turn responds to the centrifugal regulator comprising a pair of pivoted Z-shaped flyweights 26 pivotally mounted on a pin 136 disposed on a diameter of the hub 72.

Since fuel is supplied to spring chamber 115 at all times when the pump is rotating, spill from the passage 130 will determine the pressure within the spring chamber 115 and thus the hydraulic force which cooperates with the spring 114 to act on the regulator piston 112 against the bias of the output pressure of the transfer pump 18. Thus, where the spring force of spring 114 is equivalent to, say, 20 psi on piston 112, the regulated output pressure in passage 116 is maintained at a level of 20 psi plus the amount of hydraulic pressure in the spring chamber 115. Regulator piston 112 under the bias of spring 114 also serves to cut off fuel to the passage 116 in the event of loss of fuel input to the pump.

As shown in FIG. 1, an optional additional feed passage 124 provides communication between the annulus 120 and the speed related output pressure in passage 116 except during the initial cranking of the engine.

As the speed of rotation builds up, and the transfer pump output pressure increases, the regulator piston 112 moves to the right to uncover the return passage 137 to return any additional fuel to the inlet of transfer pump 18.

An important feature of this invention is the arrangement for obtaining the speed related pressure used for controlling and powering the actuators for the governing and other control functions. As shown in FIG. 1, the axial passage 118 in regulator piston 112 communicates with spring chamber 115 through a port 140 and annulus 120 which has a limited radial clearance to form a fixed restriction or orifice in the flow path from passage 118 to spring chamber 115.

Since the pressure differential between the ends of piston 112 must be equivalent to the force of spring 114 in order to maintain piston 112 in equilibrium, the flow of fuel into chamber 115 through orifice 140 and auxilliary passage 124 is constant at all normal operating conditions and this constant amount of fuel will be spilled to low pressure in the roller cavity through ports 142 which are controlled by pin 132 so that the force exerted on pin 132 by the fuel in passage 130 is equal to the force exerted on pin 132 by flyweights 26, thereby causing the pressure in passage 130 and spring chamber 115 to be a function of speed. In the event that the fuel supply to the pump becomes restricted so that the pressure in passage 130 cannot equal flyweight force, pin 132 will close ports 142 and there will be no flow in this circuit, and since there is no flow from one end of regulator piston 112 to the other end, there will be no pressure drop and spring 114 will push piston 112 to its extreme left hand position closing the feed to passage 116 and pumping chamber 28 thereby terminating engine operation when the pressure in passages 130 and 116 is incorrect for proper control.

Accordingly, the pressure level in spring chamber 115 is determined by the axial force applied to the pin 132 by the pair of Z-shaped flyweights 26 acting about their pivot 136 through U-shaped saddle 144. The two legs of U-shaped saddle 144 straddle the Z-shaped flyweights and are provided with elongated holes 146 which receive the pivot pin 136 an permit the axial movement of the U-shaped saddle 144.

Rotation of the drive shaft 34 causes flyweights 26 to tend to rotate about pin 136 due to centrifugal force since the center of mass 149 of the flyweight sections is axially offset from the location of pivot pin 136. The rotational torque or moment about pin 136 is equal to the centrifugal force on the flyweights times the axial offset distance, or lever arm, through which this torque acts. This torque must be opposed by an equal and opposite rotational torque caused by the hydraulic force on pin 132 acting on the outer corners 150 of U-shaped saddle 144 where the saddle engages flyweights 26 via spring 145, which preferably has a constant spring rate.

As shown in FIG. 1, the square end of pin 132 will uncover ports 142 only a slight amount to provide the required spill area and the change of area required to adjust spill as speed changes is very small so that the axial position change of pin 132 is also small. If spring 145 is omitted, and pin 132 rests directly on saddle 144, the angular position of the flyweights on pin 136 will also be substantially unchanged with speed and the presence required in passage 130 to balance centrifugal force on the flyweights will vary substantially as the square of speed. However, if spring 145 is installed, the flyweights will rotate about pin 136 a significant amount with increasing speed due to centrifugal force (which varies more than the square of speed due to the greater radius of rotation of their centers of mass) and spring 145 will compress as the load on it is increased. As the flyweight attitude changes, the axial offset between the center of mass 149 and the pivot pin 136 will be reduced reducing the rotating moment of the flyweights about pin 136 due to the marked percentage change in the lever arm at which the centrifugal force acts. Therefore, the balacing pressure required in passage 130 is markedly reduced from what it would be without spring 145. By proper selection of spring 145, the pressure in passage 130 can be substantially reduced from one which is proportional to the square of speed and made to be substantially linear with change of speed. Having a control pressure that is linear with speed rather than a square function is highly desirable because control forces are more uniform and lower pressure levels are present at high speeds. It is therefore important to incorporate in the governor, a means to reduce the rate of increase of the rotating moment of the flyweights 26 about pivot 136 to substantially less than a square function as speed increases. The use of a spring 145, rather than a solid connection between the flyweights and the pin or valve 132 is such a means. It should also be noted that, if the flyweights 26 rotate to the point where the center of mass 149 lies on a diameter of the drive shaft through pivot pin 136, the force applied to pin 132 by the flyweights would be zero. Thus locating the center of mass close to a radial position through pivot pin 136, and preferably with the center of mass at an angle of between about 10° and 30° relative to such a radial position, will aid in reducing the rate at which the pressure in passage 130 increases with speed since the rate of change of the axial offset distance with speed is rapidly decreasing with increasing speed while the radius of the center of mass is increasing very little.

Figure 4:
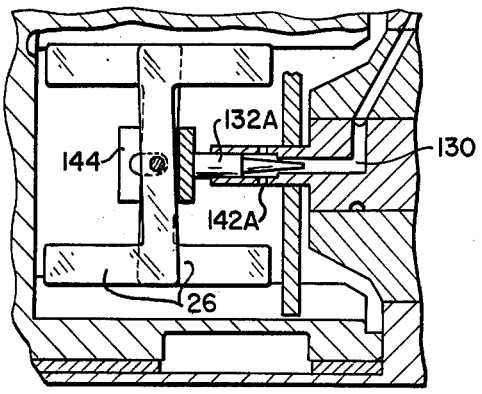
FIG. 4 is a fragmentary longitudinal cross-sectional view showing another preferred form of the flyweight for controlling the transfer pump pressure regulator of the present invention.

Other means for increasing the movement of the Z-shaped flyweights for a given increase of speed are to provide a taper on the pin 132 as shown in FIG. 4 or shaping the profile of the surface of the U-shaped saddle engaging the flyweights so that the contact point moves outward as the flyweights rotate outward or a combination of them.

The flyweight construction of this invention offers other advantages. By pivoting the integral piece Z-shaped flyweights on a pivot inside of the bearing hub 72 on a diameter thereof, the flyweights are statically balanced about pivot pin 136 and therefore are unaffected by the angle of mounting of the pump and by shock forces acting in any direction during operation, and require no additional space.

Accordingly, the flyweight means provided by this invention to create a hydraulic control pressure which may change linearly with speed offers the advanatages and versatility referred to above and in addition is unaffected by differences in the mounting methods and any instability due to shock forces encountered in use.

The pump is provided with a pump unit 152 secured to the housing 52 and is sealed thereto by any suitable means such as O-rings 154, 156. The pumping unit 152 is provided with a cylindrical projection 157 which is received within the radial bore 158 of the pump housing in alignment with the tappet 36. The pump unit 152 provides a bore 159 which serves as a cylinder for the pump plunger 38 with the cylinder bore 159 being closed at its upper end by a threaded plug 160 which seals the end of the cylinder bore 159 and is provided with an extension 161 which limits the lift of ball valve 30.

A laterally extending threaded passage 162 comunicating with cylinder bore 159 receives an externally threaded ferrule 164 which has a central passage 166, one end of which provides a seat 167 for the one way inlet ball check valve 30 which seals the high pressure pump chamber 28 during the pumping stroke of plunger 38. The opposite end of ferrule 164 is engaged by the plunger 168 of electromagnetic shut-off valve 170. Plunger 168 is normally biased to its closed position and serves to prevent the entry of fuel into the pump chamber 28 except when the electromagnetic shut-off valve 170 is energized.

A second laterally extending passage 172 communicates with the pump chamber 28 and provides a conical seat 173 for the ball valve 40 which serves as a delivery valve to maintain pressure in the passage 42 between pumping strokes. Passage 172 is sealed by a threaded plug 174 which also serves to limit the lift of the ball valve 40 from its seat. If desired, a conventional delivery valve may be substituted for the ball valve 40.

The plunger 38 is provided with an axial passage 176 which intersects a second transverse passage 178 which comes into registry with a larger diameter passage 180 communicating with the bore 184 (FIG. 3) to terminate the pumping stroke by spilling the remaining fuel in the pumping chamber 28 into the spill chamber 182 until the spring biased piston 185 forming a movable wall of the spill chamber opens a dump port 186 to discharge the remaining fuel spilled from the pumping chamber 28. Since the passage 178 in the plunger 38 is significantly smaller than the passage 180 in the bore 159, angular rotation of the plunger 38 will result in varying the vertical position at which the passages 178 and 180 will overlap and hence a different vertical position at which the pumping stroke will terminate by spilling the remainder of the pressurized fuel in pumping chamber 28. Accordingly, the amount of fuel delivered by a single pumping stroke is determined by the angular position of the pump plunger 38 relative to the spill passage 180.

As hereinbefore described, the speed related output pressure of the transfer pump 18 is present in passage 116 and in fuel supply annulus 27. This pressure is used to actuate a governor by controlling the angular rotation of pump plunger 38 through its laterally extending arm 190.

As shown in FIG. 2, the governor is provided with a beam 192 having three spherical fulcrums 193, 194 and 196 so that it may freely rotate. Spherical fulcrum 193 engages a recess in overspeed piston 198. Spherical fulcrum 194 engages governor piston 200 and spherical fulcrum 196 engages plunger control piston 202 to control the angular position of arm 190 of pump plunges 38 against the bias of spring 220.

In normal operation, overspeed piston 198 remains in a fixed position unless the transfer pump pressure in passage 116 becomes sufficiently great to overcome the force of spring 204 and provide maximum speed governing. It will be observed that the chamber 206 at the opposite end of overspeed piston 198 communicates with passage 116 through passages 210, 211, 212.

Optionally, the pressure in spring chamber 115 may be connected to the governor as indicated by the dotted lines 208 of FIG. 1 and the passage 210 eliminated.

It will suffice to say that the overspeed piston 198 remains in a fixed position unless the pressure in chamber 206 exceeds a predetermined level indicative of an overspeed condition at which time the fulcrum 196 of the beam 192 depresses plunger control piston 202 to rotate pump plunger arm 190 and reduce fuel delivery by rotating the pump plunger 38 to cause an earlier overlap between spill passage 180 and passage 178 of the pump plunger.

The governor piston 200 is subjected to the speed related hydraulic pressure in chamber 214 on one end and to the biasing force of spring 216 on the opposite end. The spring force may be varied by the position of throttle 218 and governing results by the movement of the spherical fulcrum 194 upwardly upon a reduced pressure in chamber 214 indicative of a reduction in speed to enable the plunger control piston 202 to move upwardly under the bias of spring 220 by an amount controlled by spherical fulcrum 196. Where the piston 219 is spaced from governor piston 200 as shown in solid lines in FIG. 2, full range governing is provided. If the spacing shown by the dotted line is used, the gap between pistons 200 and 219 will close at a speed just above idle speed, and governing will take place only at idle speed and at maximum speed, with the amount of fuel delivered at intermediate speeds being controlled manually by the position of throttle 218.

A torque control piston 222, which schedules the maximum amount of fuel which may be delivered in a single pumping stroke of plunger 38, is slidably mounted in a transverse bore in housing 52. One end of the torque control piston 222 is subject to the pressure in chamber 214 and spring 228 biases piston 222 toward chamber 214. Plunger control piston 202 is provided with an extension 203 engageable with a profiled surface 224 which limits the maximum fuel which may be pumped per pumping stroke according to the axial position of the torque control piston 222 which in turn is determined by the pressure in chamber 214 and hence the speed of the pump.

During cranking, when the pressure in chamber 214 is substantially zero, the governor spring 216 will move the governing piston 200 to its top position thereby permitting spring 220 to angularly adjust the arm 190 of the pumping plunger 38 for maximum fuel delivery. As indicated in the drawing, the profile 224 is provided with a notch 225 at the right hand end thereof so that the plunger 202 may move upwardly an additional amount top provide excess fuel for starting.

If desired, the profiled surface 224 on the torque piston 222 may be eccentrically disposed about its own axis so tht the rotation of the torque control piston will adjust the schedule of maximum fuel delivery up or down as desired for installation on a given engine. As shown, this adjustment may be accomplished by an adjusting screw 226 acting through the compression spring 228 to rotate the torque control piston 222. In this manner, the scheduled maximum fuel delivery for a single pumping stroke of plunger 38 may be adjusted externally of the pump.

As shown in FIG. 3, the position of tappet 36 may be adjusted to advance and retard the timing of the pumping stroke and hence the timing of injection by the lateral adjustment of the advance piston 100 against the bias of a spring 230. Transfer pump regulated pressure in fuel supply annulus 27 communicates with a chamber 232 at the end of advance piston 100 through passages 234 and 236 and past a one way check valve 238. Controlled leakage past the advance piston 100 permits the advance piston 100 to move to a retard position under the influence of the force transmitted between the rollers 32 and the camming surface of the tappet 36 during pumping strokes.

As is conventional, the pump housing 52 is filled with fuel for lubrication purposes and any leakage past any piston or plunger of the pump is ultimately returned to the fuel tank past a spring biased one way valve 240 (FIG. 2) which maintains a positive pressure in the pump to prevent the collection of air within the pump and to assure that the pump is continuously full of fuel.

As hereinbefore stated, the output of the transfer pump is in continuous communication with the fuel supply annulus 27 at all times during the operation of the pump. Upon the termination of the pumping stroke of plunger 38 by the registry of passages 178 and 180 (FIG. 3), the inlet check valve 30 may immediately unseat so that the pump chamber 28 may be refilled. It will be noted that there is no return spring associated with the free piston type pump plunger 38 and the pump plunger is powered during its charging stroke solely by hydraulic pressure. Whenever the pressure in pump chamber 28 is lower than the pressure in fuel supply annulus 27, the plunger 38 is hydraulically powered to its lowest position with the shoulder 108 engaging the stop 106 to assure a complete filling of the chamber 28 prior to every pumping stroke. In this manner, the quantity of fuel in the pump chamber 28 is exactly the same at the beginning of each sequential pumping stroke and the angular position of pumping plunger 38 solely determines the termination of the pumping stroke due to spill into passage 180 thereby assuring the delivery of a uniform quantity of fuel in sequential pumping strokes for a given angular setting of the pumping plunger 38.

Figure 5:
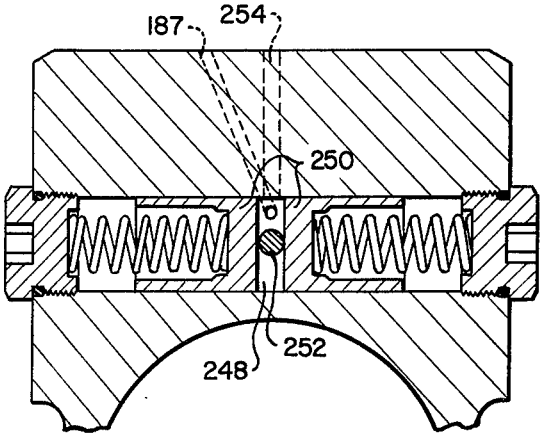
FIG. 5 is a fragmentary cross-sectional view taken along line 5–5 of FIG. 1.

In this regard, and as shown in FIG. 3, the spill chamber 182 may be provided to assist in the initial filling of the pump chamber 28. The biasing spring for accumulator piston 185 may be selected to maintain a high pressure, say 200 psi, on the fuel contained therein thereby to provide initial impetus to overcome any hydraulic inertia to the flow of fuel from fuel supply annulus 27 at the beginning of the filling stroke. In addition, and as shown in FIGS. 1 and 5, an additional accumulator may be connected to annulus 27 by passage 254 having a restrictor 255 to serve as an auxilliary source of fuel to even out any pulsations of fuel pressure caused by the sudden changes in the demands for fuel in charging the pump chamber 28. This accumulator is shown as being connected to receive the fuel dumped by spill chamber 182 through dump port 186 (which is isolated from fuel supply annulus 27) and passage 187 to prevent fluctuations in the pressure in annulus 27 due to the sudden spill of fuel from spill chamber 182. Such an accumulator may be provided by a pair of spring biased pistons 250 spaced by a pin 252 to assure a minimum sized chamber connected to the annulus 27 by a passage 254 (FIG. 1).

A feature of this invention is that the hollow hub 72 of drive shaft 34 serves to mount the rollers 32 which are positioned in drilled longitudinal passages therein. By virtue of this construction, it is readily apparent that the rollers which actuate the tappet 36 are held captive by the hub 72 and may be readily replaced. Moreover, a pump may be converted from, say, a six cylinder pump to a three cylinder pump by the simple expedient of removing alternate rollers. In addition, this construction is one which is readily adapted to changes in the angular placement of the rollers 32 for use with engines having different number of cylinders and to provide pumping strokes having uneven intervals between them thereby to accommodate engines needing such uneven intervals as may occur in some V-type engines.

As shown in FIG. 1, the rollers 32 are of a length so that they may move axially a slight amount in use. This aids in their lubrication and freedom to roll on the camming surface of the tappet 36 and improves their wearing characteristics. Preferably, the hub is formed of sintered iron for ease of manufacture and to improve lubrication.

As will be apparent to persons skilled in the art, various modifications, adaptations and variations can be made from the foregoing specific disclosure without departing from the teachings of the present invention.

I claim:

1. A liquid fuel injection pump suited for the delivery of measured charges of liquid fuel under high pressure sequentially to the cylinders of an associated engine comprising a pump chamber wherein the charges are pressurized to high pressure, a pump plunger reciprocably mounted in said pump chamber, a stop for said pump plunger to limit the maximum volume of said chamber, mechanical means for driving said pump plunger in a direction to reduce the volume of said pump chamber to pressurize the fuel therein, hydraulic means to power said pump plunger in the opposite direction, said hydraulic means including a passage containing fuel under pressure in continuous communication with said pump chamber, a one way valve in said passage unseated by the pressure therein after the release of the pump plunger by said mechanical means to power the plunger against said stop and fully charge said pump chamber priorto each pumping stroke of the pump plunger, and a spill chamber which communicates with a spill port of said pump plunger to terminate the pumping stroke of said pump plunger by spilling the remainder of the charge of fuel in said pumping chamber, a dump port in the wall of said spill chamber, a spring biased piston in said spill chamber to control the dumping of fuel through said dump port, said spill chamber communicating with said pump chamber upon the release of the pump plunger by the mechanical means to provide an auxiliary quantity of fuel to assist in the charging of the pump chamber during the subsequent charging stroke of the pump plunger.

2. The pump of claim 1 including an accumulator communicating with said passage to assist in supplying fuel to said pump chamber during charging strokes of the pump plunger.

3. The pump of claim 2 wherein said accumulator is connected to said passage through a restricted orifice.

4. The pump of claim 1 wherein said dump port discharges into an accumulator, said accumulator communicating with said passage through a restricted orifice to assist in supplying fuel to said pump chamber during charging strokes of the plunger.

5. A liquid fuel injection pump suited for the delivery of measured charges of liquid fuel under high pressure sequentially to the cylinders of an associated engine comprising a stationary housing providing a pump chamber, a pump plunger mounted for reciprocation in said chamber, a cross bore in said housing having a hub journaled therein, said hub having a plurality of longitudinal bores adjacent the periphery thereof, rollers respectively journaled in said longitudinal bores with a portion of the rollers exposed through the outer peripheral surface of the hub, the exposed portions of said rollers being operatively connected to drive said pump plunger to pressurize the charges of fuel in said pump chamber, said rollers being secured to the hub against their centrifugal force.

6. The pump of claim 5 wherein the exposed portion of the rollers constitutes less than one-half the diameter thereof.

7. The pump of claim 5 wherein a tappet is interposed between said pump plunger and said hub, said tappet being provided with a camming surface engageable by said rollers.

8. The pump of claim 7 wherein the exposed portion of each roller is oriented so that a line perpendicular to the camming surface through the line of contact between the camming surface and the roller will pass through an unexposed portion of the roller.

9. The pump of claim 7 including a second cross bore in said housing, a timing control piston mounted in said second cross bore, said piston having a diametral bore, and said tappet being mounted for reciprocation in said bore.

10. The pump of claim 9 wherein said timing control piston includes a stop to limit the travel of said tappet toward said hub.

11. A liquid fuel injection pump suited for the delivery of measured charges of liquid fuel under high pressure sequentially to the cylinders of an associated engine including a pump chamber wherein the charges are pressurized to high pressure, comprising a source of fuel under pressure, a pressure regulator including a regulator valve having a pressure chamber at each end thereof, a spring for biasing the valve in one direction, a passage providing continuous communication between said source of fuel and one of said pressure chambers, an outlet port to deliver fuel from said one chamber to said pump chamber, passage means connecting the pressure chambers, means forming a fixed restriction in said passage means to cause a substantially constant rate of flow of fuel therethrough, and means for varying the pressure of fuel in the other of said chambers to control the pressure at said outlet port.

12. The pump of claim 11 wherein said valve controls communication between said one chamber and said outlet port, and said spring biases said valve to close said outlet port when the pressure differential between said pressure chambers falls below a predetermined level.

13. The pump of claim 11 wherein said means for varying the pressure in the other of said chambers comprises a discharge orifice having a valve biased in opposition to the pressure in the other of said chambers by a force correlated with engine speed.

14. The pump of claim 12 wherein said valve is biased by flyweights.

15. The pump of claim 14 wherein said flyweights include means for reducing the rate of increase of the rotating moment of the flyweights applied to said valve with increasing speed.

16. The pump of claim 14 where a spring is provided to transmit the force from said flyweights to said valve.

17. The pump of claim 14 where the end of said valve which cooperates with said discharge orifice converges toward the end thereof.

18. A liquid fuel injection pump suited for the delivery of measured charges of liquid fuel under high pressure sequentially to the cylinders of an associated engine including a pump chamber wherein the charges are pressurized to high pressure, a pressure regulator for generating a hydraulic pressure correlated with engine speed comprising a pressure chamber having a variable discharge orifice and a valve for controlling said orifice to vary the rate of discharge therefrom, pivoted flyweight means for generating a centrifugal force at least equal to the square of the speed of the pump for urging said valve in a direction to reduce the size of said discharge orifice against the force of the pressure within said pressure chamber, and means for reducing the rate of increase of the rotating moment of the flyweights about their pivot with increasing speed.

19. The pump of claim 18 wherein the flyweight means is connected to the valve through a spring.

20. The pump of claim 19 wherein the spring has a substantially constant spring rate.

21. The pump of claim 18 wherein the end of the valve which cooperates with said discharge orifice converges toward its end.

22. The pump of claim 18 wherein the center of mass of said flyweight means is positioned at an angle of between about 10° to 30° from a radial line through its pivot while in its operating position.

23. The pump of claim 18 including means for changing the effective lever arm transmitting the hydraulic force on said valve to said flyweight means.

24. The pump of claim 18 wherein said flyweight means comprises an integral substantially Z-shaped member pivoted about its geometric center.

25. The pump of claim 24 wherein said pump includes a hollow hub, and said flyweight means are pivoted along a diametral line of said hub within said hollow hub.

26. The pump of claim 18 wherein means are provided to deliver a substantially constant rate of flow of fuel into said pressure chamber.

27. The pump of claim 26 wherein the pressure regulator comprises a spring biased piston having the pressure chamber at one end and a supply chamber at the other and a flow path having a fixed orifice connects said pressure chamber and said supply chamber.

28. A liquid fuel injection pump suited for the delivery of measured charges of liquid fuel under high pressure sequentially to the cylinders of an associated engine including a pump chamber wherein the charges are pressurized to high pressure and a source of fuel under a pressure correlated with engine speed comprising, control means for regulating the quantity of fuel delivered to the engine during a single pumping stroke including a first bore forming a pressure chamber connected to receive fuel from said source, a first piston in said bore, a spring biasing said first piston in a direction opposed to the pressure of the fuel in said pressure chamber, actuating means controlled by said first piston to regulate the fuel delivered to the engine, a second bore intersecting said first bore, a second piston in said second bore having one end exposed to the pressure in said pressure chamber, a spring biasing said second piston in a direction opposed to the pressure of the fuel in said pressure chamber, said second piston having a profiled surface engageable with said actuating means to provide an override for the maximum fuel delivered to said engine.

29. The pump of claim 28 wherein a spring biases said actuating means in a direction of increased fuel and a beam controlled by said first piston limits the movement of said actuating means under the bias of said last mentioned spring.

30. The pump of claim 29 wherein a fulcrum of said beam engages a third piston, a pressure chamber connected to receive fuel from said source associated with said third piston, a spring biasing said third piston to a fixed position except when the engine speed reaches an overspeed condition to cause the third piston to pivot the beam to limit the movement of said actuating means under the bias of its biasing spring.

31. The pump of claim 30 wherein the fulcrums of said beam engageable with said first piston, said third piston and said actuating means respectively are spherical.

32. The pump of claim 28 including a throttle for adjusting the bias of the biasing spring for said first piston.

33. The pump of claim 28 wherein said second piston is cylindrical, the profiled surface thereof is disposed eccentrically of the axis thereof, and means are provided for controlling the angular orientation of said second piston.

34. The pump of claim 33 wherein said angular control means comprises the biasing spring for said second piston.

35. The pump of claim 30 wherein said profiled surface is provided with a notch engageable with said actuating means when minimum pressure is present in said pressure chamber to provide excess fuel for starting.

36. A liquid fuel injection pump suited for the delivery of measured charges of liquid fuel under high pressure sequentially to the cylinders of an associated engine comprising a stationary housing providing a pump chamber, a plunger mounted for reciprocation in said chamber along a first axis, a bore in said housing having a hub journaled therein, said hub having an axis generally perpendicular to said first axis and mounting a plurality of rollers around its periphery, a tappet provided with a camming surface engageable by said rollers interposed between said pump plunger and said hub to drive said pump plunger to pressurize the charges of fuel in said pump chamber, timing control means connected to shift the camming surface of said tappet relative to the axis of said hub to change the rotational position of the rollers relative to the axis of the hub at which the rollers engage the camming surface of the tappet to modify the pumping rate of the pump.

37. The pump of claim 36 in which the camming surface of the tappet is concave so that the pumping rate of the pump is increased when the timing control means is moved toward a timing advance direction.

* * * * *

UNITED STATES PATENT AND TRADEMARK OFFICE

CERTIFICATE OF CORRECTION

PATENT NO. : 4,100,903

DATED : July 18, 1978

INVENTOR(S) : Vernon D. Roosa

It is certified that error appears in the above-identified patent and that said Letters Patent are hereby corrected as shown below:

Column 3, line 58, "beings" should be --begins--.

Column 4, line 64, "an" should be --and--.

Column 5, line 18, "presence" should be --pressure--.

Column 5, line 31, "balacing" should be --balancing--.

Column 7, line 7, "plunges" should be --plunger--.

Column 7, line 41, "line" should be --lines--.

Column 8, line 3, "tht" should be --that--.

Column 9, line 54, "priorto" should be --prior to--.

Column 12, line 41, "30" should be --28--.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*